US006171408B1

(12) United States Patent
Herzer et al.

(10) Patent No.: US 6,171,408 B1
(45) Date of Patent: Jan. 9, 2001

(54) PROCESS FOR MANUFACTURING TAPE WOUND CORE STRIPS AND INDUCTIVE COMPONENT WITH A TAPE WOUND CORE

(75) Inventors: Giselher Herzer, Bruchköbel; Kurt Emmerich, Alzenau, both of (DE)

(73) Assignee: Vacuumschmelze GmbH, Munich (DE)

( * ) Notice: Under 35 U.S.C. 154(b), the term of this patent shall be extended for 0 days.

(21) Appl. No.: 09/125,409

(22) PCT Filed: Nov. 6, 1997

(86) PCT No.: PCT/DE97/02585

§ 371 Date: Aug. 18, 1998

§ 102(e) Date: Aug. 18, 1998

(87) PCT Pub. No.: WO98/28758

PCT Pub. Date: Jul. 2, 1998

(30) Foreign Application Priority Data

Dec. 20, 1996 (DE) ..... 196 53 428

(51) Int. Cl.[7] ..... C21D 1/04
(52) U.S. Cl. ..... 148/108; 29/605
(58) Field of Search ..... 148/108; 29/605

(56) References Cited

U.S. PATENT DOCUMENTS 4,525,222 6/1985 Meguro et al. ..... 148/121
4,668,309 * 5/1987 Silgailis et al. ..... 148/108
4,769,091 9/1988 Yoshizawa et al. ..... 148/108
5,256,211 * 10/1993 Silgailis et al. ..... 148/108
5,568,125 * 10/1996 Liu ..... 340/551
5,676,767 * 10/1997 Liu et al. ..... 148/108
5,757,272 * 5/1998 Herzer et al. .

FOREIGN PATENT DOCUMENTS 33 24 729 C2 1/1991 (DE) .
0 737 986 A1 10/1996 (EP) .

OTHER PUBLICATIONS

Abstract for Japanese Application No. 64–152122 dated Jan. 28, 1991.

* cited by examiner

*Primary Examiner*—John Sheehan
(74) *Attorney, Agent, or Firm*—Schiff Hardin & Waite

(57) ABSTRACT

In a method for strip-wound core strips composed of amorphous ferromagnetic material, an amorphous ferromagnetic strip composed of a cobalt-based alloy which contains additives of iron and/or manganese in a proportion of between 1 and 10% by atomic weight of the alloy is cast from a melt by means of rapid solidification. The amorphous ferromagnetic strip is then subjected to a magnetic field transversely with respect to the strip direction as it passes through heat treatment. Once the strip-wound core strips have been cut to length from the heat-treated, amorphous ferromagnetic strip, strip-wound cores, preferably toroidal strip-wound cores, are wound. These strip-wound cores can be used to produce inductive components which have excellent magnetic characteristics, and, in particular, inductive components can be produced whose toroidal strip-wound cores have a mean diameter of d≦10 mm.

7 Claims, 5 Drawing Sheets

PROCESS FOR MANUFACTURING TAPE WOUND CORE STRIPS AND INDUCTIVE COMPONENT WITH A TAPE WOUND CORE

BACKGROUND OF THE INVENTION

1. Field of the Invention The invention relates to an inductive component having a strip-wound core which is wound from an amorphous ferromagnetic alloy, as well as to a production method for strip-wound core strips composed of amorphous ferromagnetic material.

2. Description of the Prior Art

In order to achieve good soft-magnetic characteristics, amorphous ferromagnetic alloys which are virtually free of magnetostriction must also be subjected to heat treatment. Typically, they are in this case tempered in a magnetic field in order to deliberately achieve a flat B-H loop.

The latter is carried out according to the prior art on ready-wound strip-wound cores since, as a rule, the amorphous material becomes brittle during tempering and the reduction in internal mechanical stresses required for maximum permeabilities can be achieved, these stresses being a result of production and also being caused by the winding of the strip-wound core.

One possibility for producing amorphous ferromagnetic strip-wound core strips which have been heat treated in a magnetic field is stationary heat treatment of the strip-wound core strips, which have been wound into coils for delivery, in so-called transverse-field furnaces. However, this method is highly critical with regard to good reproducibility. Since large amounts of material are involved, relatively long treatment times of several hours, and up to days in the worst case, must be carried out in order to ensure that the coils for delivery are uniformly heated through. Owing to the long treatment times, it is in this case necessary to operate at relatively low temperatures in the region of about 200° C.≦T≦250° C., in order to preclude thermal embrittlement of the material. However, this means that the variability range of the magnetic characteristics that can be achieved is very greatly limited, particularly with regard to the achievable permeabilities.

German Patentschrift 33 24 729 discloses a method for production of an amorphous magnetic alloy having a high permeability, in which a strip composed of an amorphous magnetic cobalt/basic alloy, which has a material proportion of iron of 5%, is produced by means of rapid solidification, and in which the amorphous magnetic strip is subjected to a magnetic field transversely with respect to the strip direction as it passes through heat treatment.

SUMMARY OF THE INVENTION

The invention is thus based on the object of developing this production method for strip-wound core strips composed of amorphous ferromagnetic material further such that strip-wound cores, in particular to form toroidal strip-wound cores, and inductive components produced from them can be produced economically and while saving energy, at low cost, and in the case of which components it is possible to achieve considerably higher permeabilities and, in consequence, improved magnetic characteristics.

This object is achieved according to the invention by a production method which is characterized by the following steps:

a) an amorphous ferromagnetic strip composed of a cobalt alloy which contains additives of iron and/or manganese in a material proportion of between 1 and 10% of the alloy is cast from a melt by means of rapid solidification;

b) the amorphous ferromagnetic strip is subjected to a magnetic field transversely with respect to the strip direction as it passes through heat treatment, the speed of movement being selected such that the amorphous ferromagnetic strip is heated to a temperature of 250°≦T≦450° C. for a heat treatment time of 0.5 s≦t≦60 s.

c) the strip-wound core strips are cut to length from the heat-treated, amorphous ferromagnetic strip.

The production method according to the invention can be carried out with the smallest possible amount of energy. Ductile, amorphous strip-wound core strips having flat B-H loops can be produced in this way which have a very highly linear response into their saturation region and have a permeability range of between about 2000 and 15,000. Owing to the capability to trim the magnetostriction precisely, the strips can be used to produce strip-wound cores, in particular toroidal strip-wound cores, which have a winding diameter of d≦10 mm, without any significant adverse effect on the magnetic characteristics.

Furthermore, no barrier gas is required in the course of the heat treatment and, in particular, the exposure to air is even advantageous since the thin oxidation layer produced on the strip-wound core strips assists the required electrical strip layer insulation.

Particularly excellent strip-wound core strips can be achieved at speeds of movement which are set such that the amorphous ferromagnetic strip is heated to a temperature of 300° C.≦T≦400° C. for a heat-treatment time of t≦30 s.

In a development of the invention, the proportion of iron and/or manganese in the alloy is set such that the amorphous ferromagnetic strip has a saturation magnetostriction of $\lambda_s \leqq 0.1$ ppm, preferably $\lambda_s \leqq 0.05$ ppm, after the heat treatment.

In the case of the inductive component according to the invention, the strip-wound core is accordingly wound from a ductile, heat-treated strip-wound core strip composed of an amorphous ferromagnetic alloy, the amorphous ferromagnetic alloy having a saturation magnetostriction of $\lambda_s \leqq 0.1$ ppm as well as a flat B-H loop which runs as linearly as possible into the saturation region. The amorphous ferromagnetic alloy is in this case a cobalt-based alloy which contains material proportions of iron and/or manganese of between 1 and 10% by atomic weight of the alloy. The strip-wound core strip is thus heat-treated before being wound and, as a result of the ductility achieved, the strip-wound cores can be wound without any problems.

Depending on the quality being aimed for and the desired versatility of the inductive component, the strip-wound cores can have a mean diameter of d≦50 mm, and even a mean diameter of d≦10 mm.

In particular, inductive components can be produced which have toroidal strip-wound cores.

DESCRIPTION OF THE PREFERRED EMBODIMENTS

Two charges of the alloys VC6030 and VC6150B60, each having a strip width of 6 mm and a strip thickness of about 20 $\mu$m, were investigated. The composition of the alloys and their magnetic characteristics in the production state are shown in Table 1.

TABLE 1

Nominal composition, strip thickness, saturation induction $B_s$ and saturation magnetostriction $\lambda_s$ (in the production state) of the charges investigated.

| Designation | Alloy Composition | (Material proportion in %) Batch | Thickness ($\mu$m) | $B_s$ (T) | $\lambda_s$ ($10^{-8}$) |
|---|---|---|---|---|---|
| VC 6030 D30 | $Co_{71.8}Fe_{1.2}Mn_4Mo_1Si_{13}B_9$ | E 4405 | 17.0 | 0.807 | −17.3 |
| | | 201-1559 | 17.6 | 0.821 | −10.8 |
| VC 6150 B60 | $Co_{72.5}Fe_{1.5}Mn_4Si_5B_{17}$ | 201-481 | 20.2 | 0.987 | −15.2 |
| | | E 4286 | 18.2 | 0.975 | +8.8 |

The amorphous ferromagnetic strips were cast from a melt by means of rapid solidification and were then heat-treated as they pass continuously through a transverse-field furnace about 40 cm long at a speed of movement of 1.6 m/minute, at various temperatures. The magnetic field of about 159.200 A/m applied at right angles to the strip direction and in the strip plane during the heat treatment was produced by a permanent magnet yoke with a length of about 40 cm which is located in the continuous-flow furnace.

Figure 1:
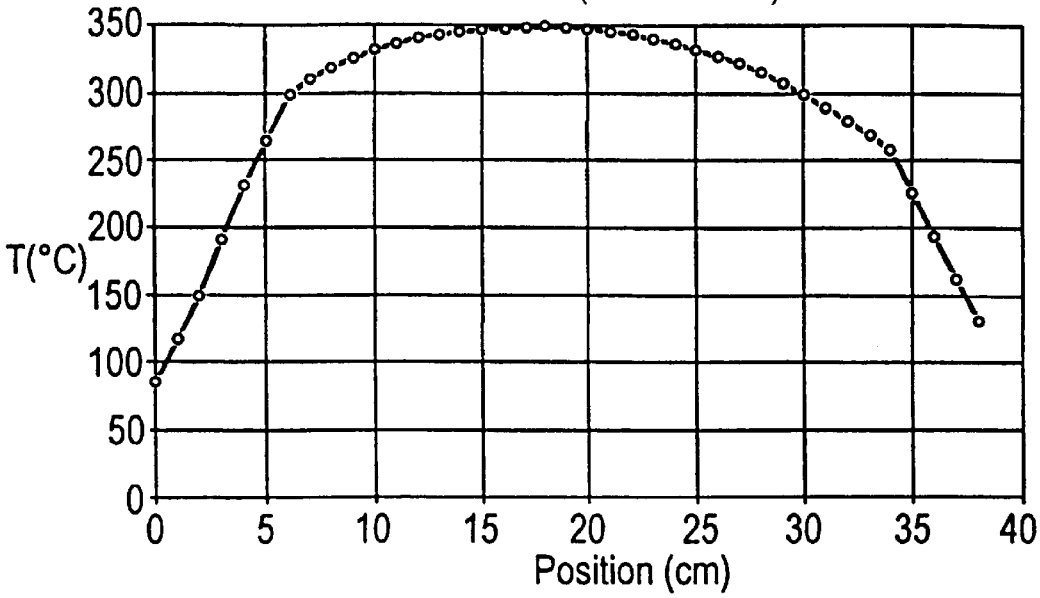
FIG. 1 (PRIOR ART)
FIG. 1 shows a typical temperature profile of a continuous-flow furnace used for production, with a nominal temperature of 350° C.

FIG. 1 shows the typical temperature profile of the continuous-flow furnace. The length of the homogeneous temperature zone was about 15 to 20 cm, the above speed of movement corresponding to an effective heat-treatment time of about 7 seconds. After shortening the treatment time and using a 2 m-long furnace of similar design, it was possible to increase the speed of movement to about 10 to 20 m/minute.

The saturation magnetostriction $\lambda_s$ and the B-H loop in the stretched state were measured on the strip that had been subjected to the transverse field. The evaluation covered the anisotropy field strength $H_A$ and, in accordance with the equation $$\mu = B_s/(\mu_0 H_A)$$

the mean permeability $\mu$.

Once the strip-wound core strips had been cut to length from the strip that had been heat-treated at 350° C., toroidal strip-wound cores whose dimensions were 22×16×6 mm and 12×8×6 mm were wound in order to check the extent to which the winding stresses influence the characteristics of the material.

Figure 2:
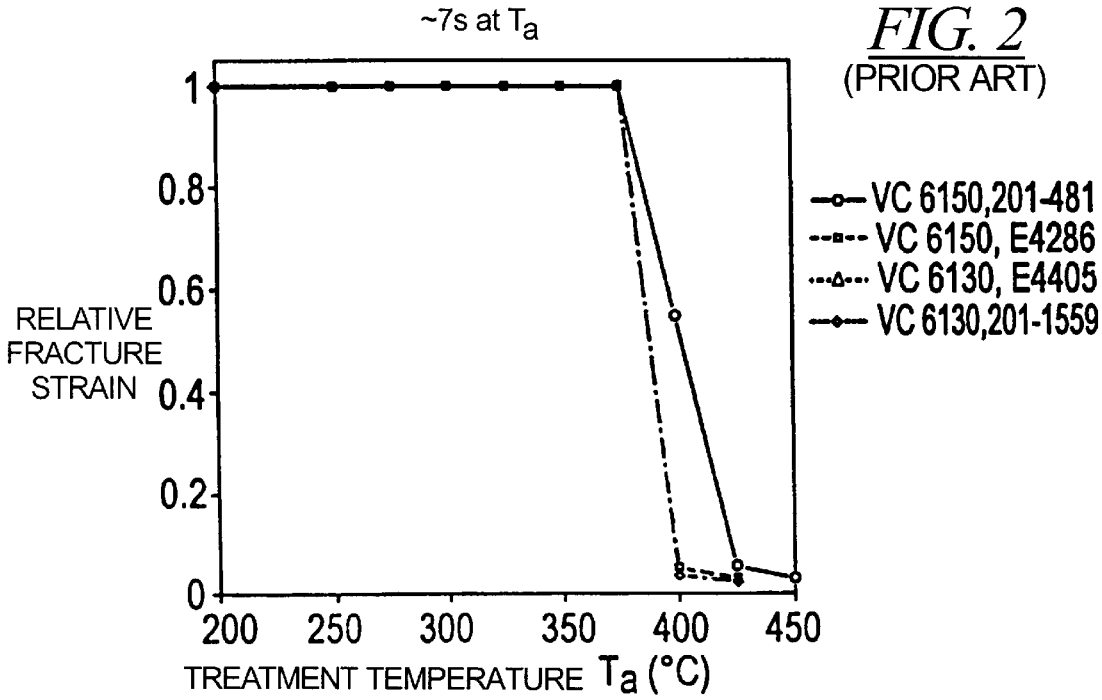
FIG. 2 (PRIOR ART)
FIG. 2 shows the relative fracture strain $\epsilon_F$ after the continuous-flow heat treatment as a function of the heat-treatment temperature.

Furthermore, the ductility of the heat-treated material was determined by kinking and tearing tests. As can be seen from FIG. 2, with the selected heat-treatment time, embrittlement does not occur until relatively high heat-treatment temperatures of around 380° C. An increased heat-treatment temperature can therefore be selected without any problems, which leads to satisfactory stress relaxation and to rapid kinetics of the setting of the induced anisotropy.

Figure 3A:
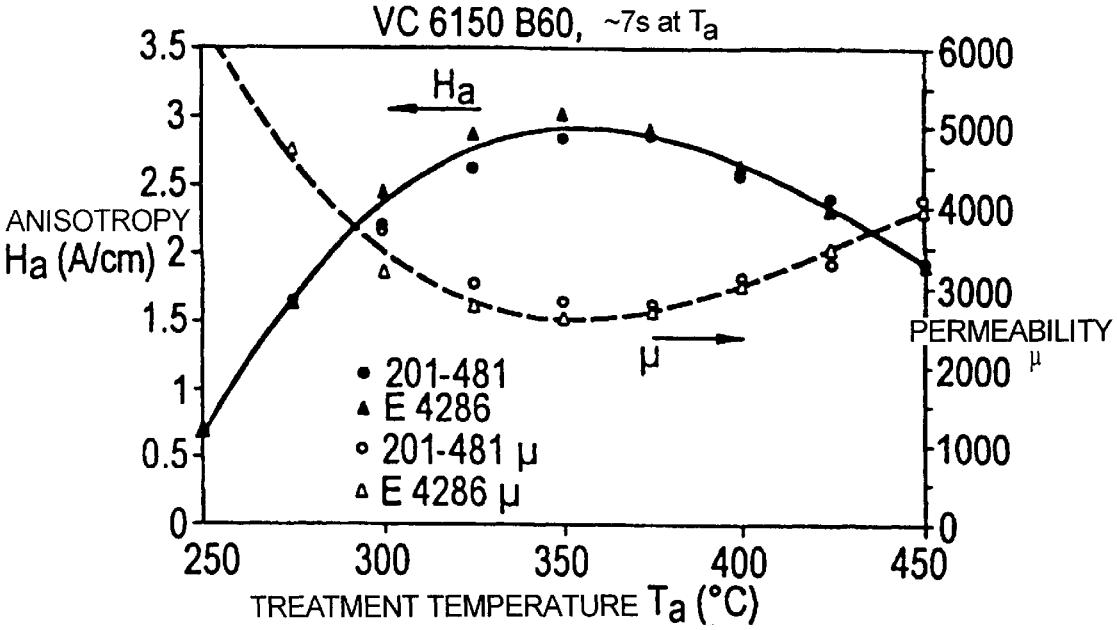
FIG. 3 shows the anisotropy field strength $H_A$, average permeability level $\mu$ and saturation magneto striction $\lambda_s$ of a strip-wound core strip according to the invention after continuous-flow heat treatment in a transverse magnetic field, as a function of the heat-treatment temperature $T_a$.
Figure 3B:
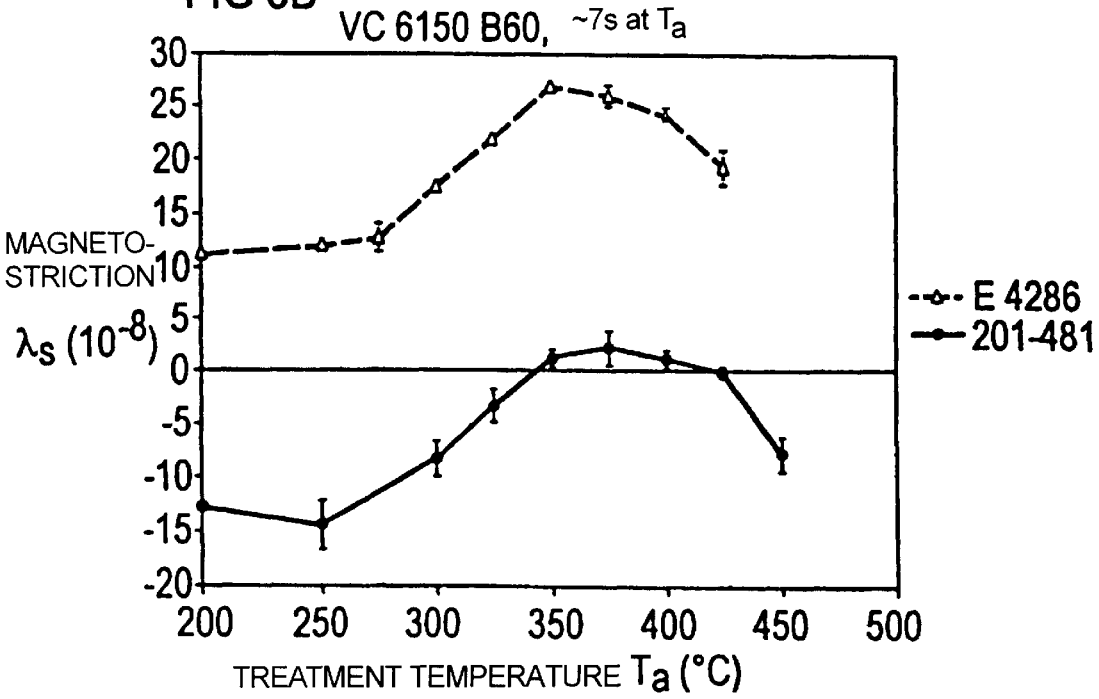
Figure 4A:
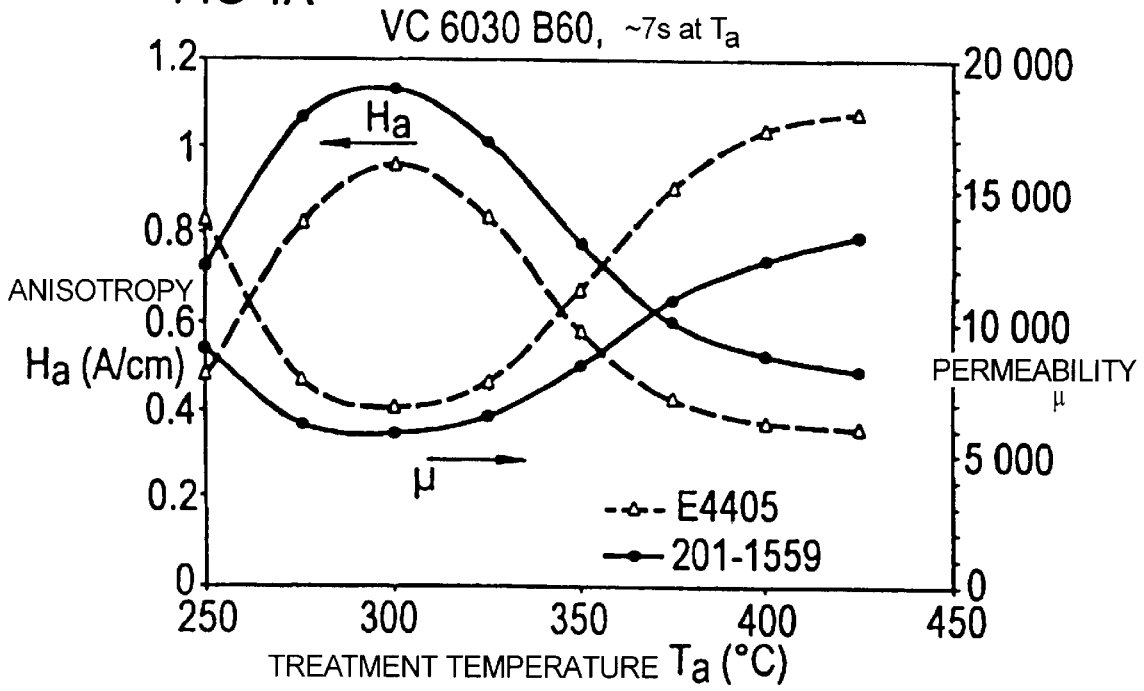
FIG. 4 shows the anisotropy field strength $H_A$ average permeability level $\mu$ and saturation magneto striction $\lambda_s$ of a further strip-wound core strip according to the invention after heat treatment in a transverse magnetic field, as a function of the heat-treatment temperature $T_a$.
Figure 4B:
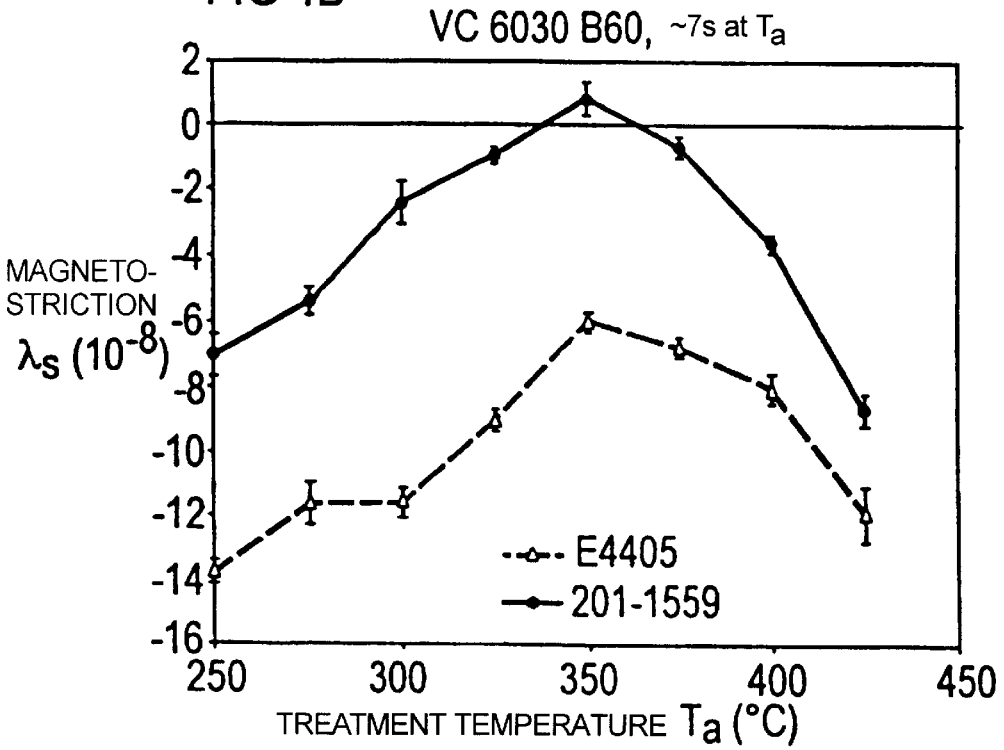

As can be seen from FIGS. 3 and 4, the resultant effect is in principle that the permeability can be set as required by selection of the alloy composition and the heat-treatment parameters.

Figure 5A:
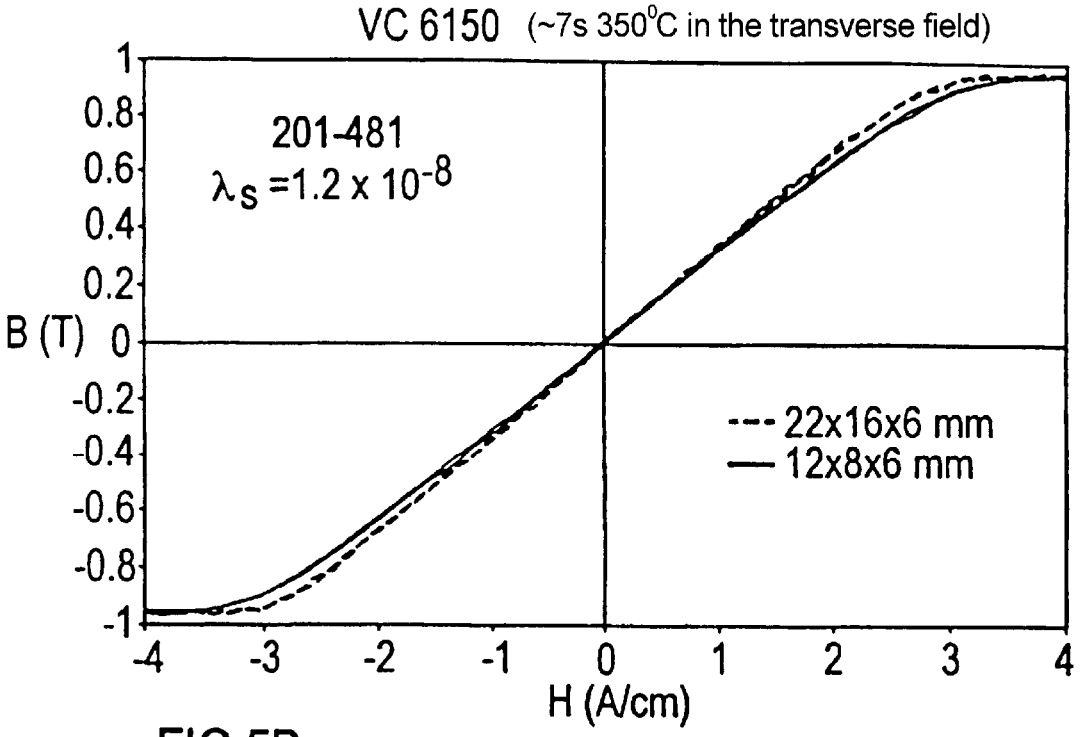
FIG. 5 shows quasi-static B-H loops measured for toroidal strip-wound cores having dimensions 22×16×6 mm and 12×8×6 mm made from strip-wound core strips which have been treated as they pass through a transverse magnetic field.
Figure 5B:
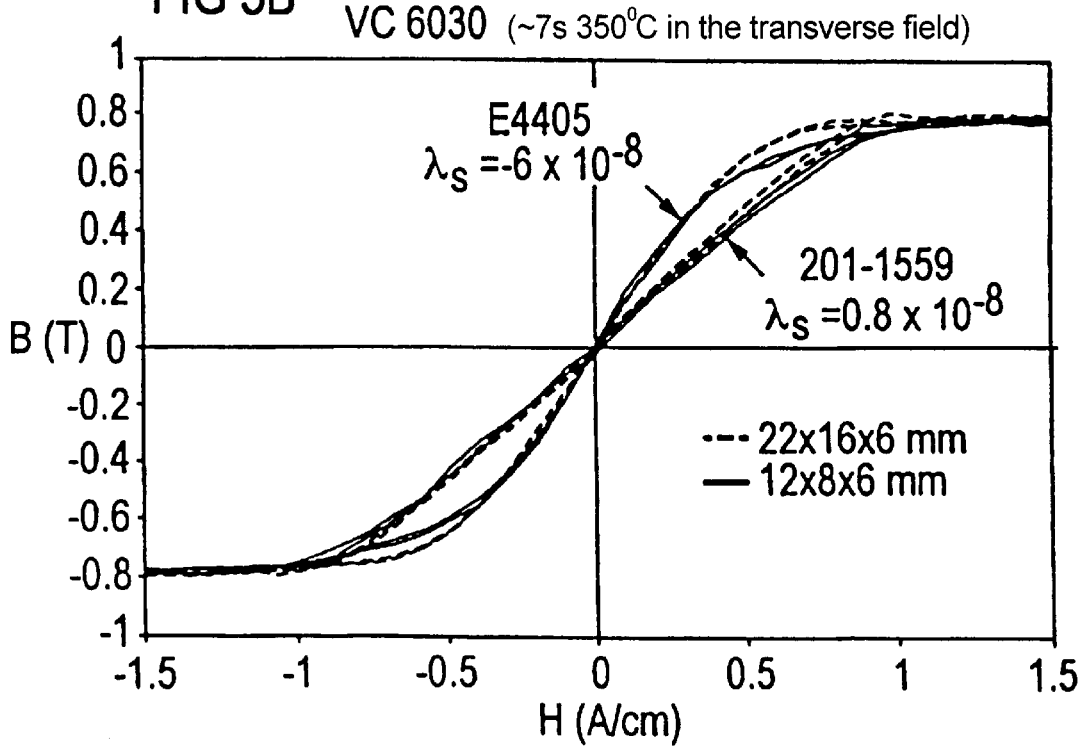
Figure 6:
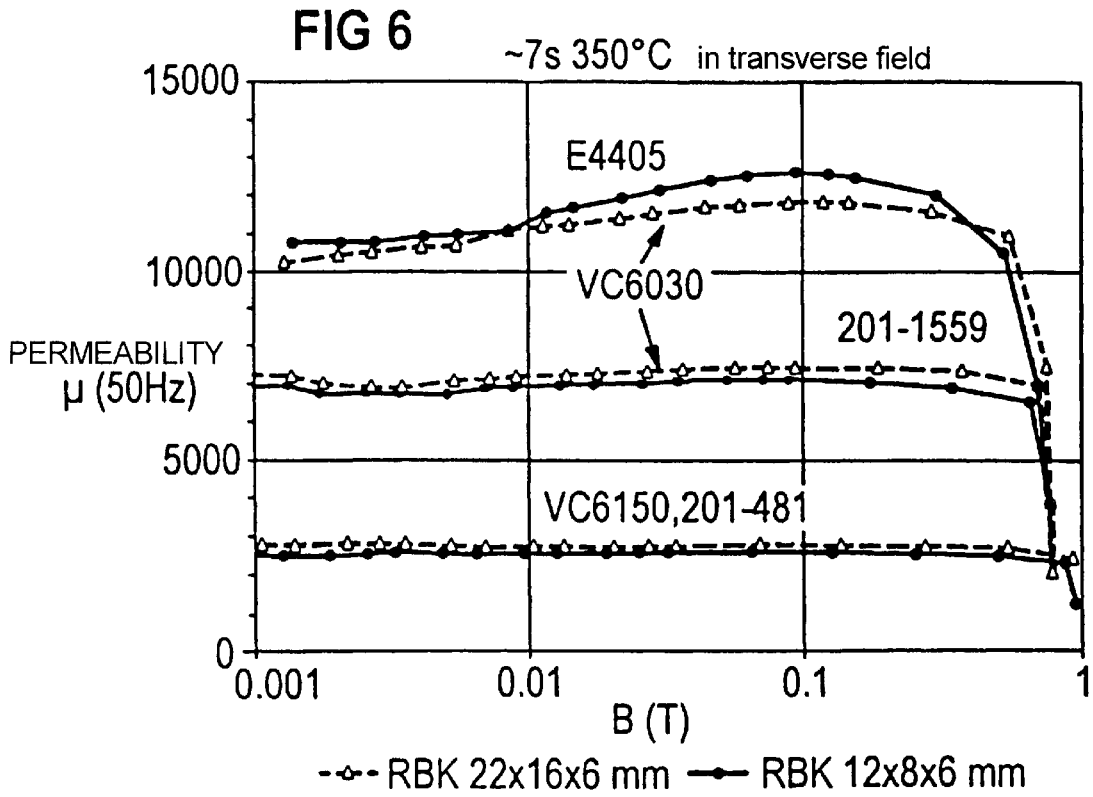
FIG. 6 shows amplitude permeabilities at 50 Hz, measured for toroidal strip-wound cores having dimensions 22×16×6 mm and 12×8×6 mm from strip-wound core strips which have been treated as they pass through a transverse magnetic field.

FIG. 5 shows the B-H loops of the toroidal strip-wound cores wound from the heat-treated strip-wound core strip. The amplitude permeability of the toroidal strip-wound cores is illustrated in FIG. 6.

In particular, it was found that very flat and linear B-H loops can be obtained even with small core dimensions of 12×8 mm, and these B-H loops are virtually uninfluenced by the winding stresses that occur.

Rounding of the B-H loops was observed only with incorrectly trimmed magnetostriction and an increased permeability level of $\mu$>10,000 (as can be seen in FIG. 5), owing to the winding stresses. In order to avoid the influence of winding stresses, it is therefore important to trim the saturation magnetostriction that exists after the heat treatment as well as possible to zero. A specific, slightly negative value of $\lambda_s$ must therefore be set in the production state, this value being alloy-specific for given heat-treatment parameters.

Figure 7:
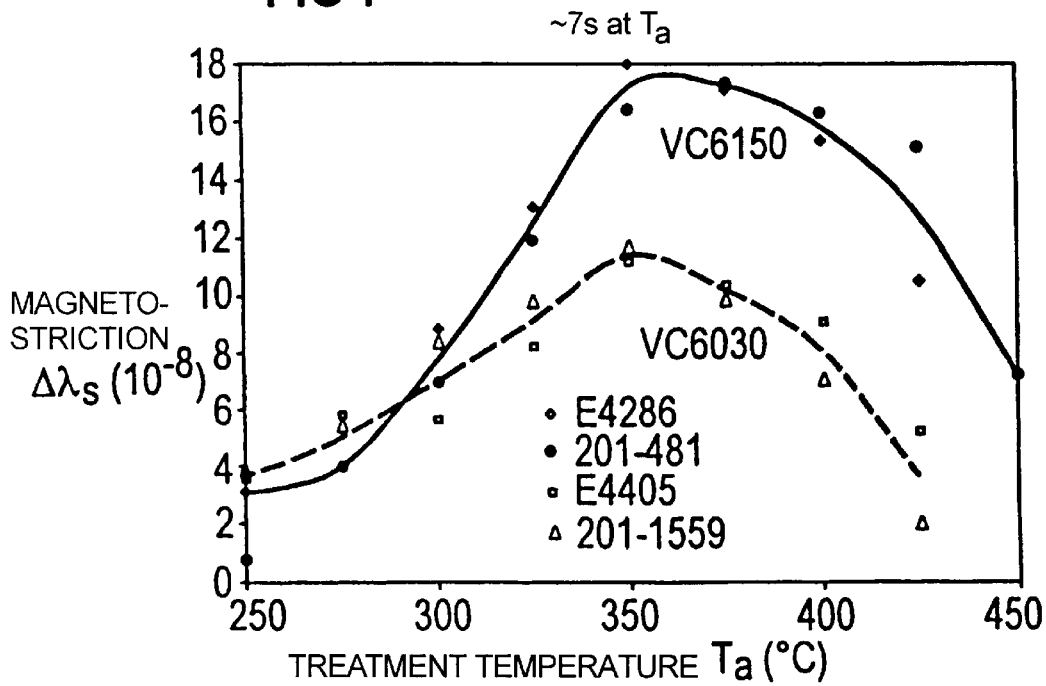
FIG. 7 shows the changes in the saturation magneto striction $\lambda_s$ of the two strip-wound core strips according to the invention after continuous-flow heat treatment in a transverse magnetic field, as a function of the heat-treatment temperature $T_a$.

In this context, FIG. 7 shows the profile for the change in the magnetostriction after the heat treatment for the two alloys investigated.

The magnetostriction trimming must be carried out more precisely than in the case of the material which is not heat-treated until after the toroidal strip-wound cores have been wound. The optimum magnetostriction after the heat treatment is $-2\times10^{-8}<\lambda_s<2\times10^{-8}$. This allows strip-wound core strips that have been heat-treated in the transverse field to be used to produce toroidal strip-wound cores with diameters down to less than 10 mm and a permeability level of about 2000 to 15,000.

Although modifications and changes may be suggested by those of ordinary skill in the art, it is the intention of the inventors to embody within the patent warranted hereon all changes and modifications as reasonably and properly come within the scope of their contribution to the art.

What is claimed is:

1. A production method for strip-wound core strips composed of amorphous ferromagnetic material, comprising the following steps:

a) casting an amorphous ferromagnetic strip composed of a cobalt-based alloy which contains additives of iron and/or manganese in a material proportion of between 1 and 10 atomic percent of the alloy from a melt by rapid solidification, said strip having a longitudinal strip direction;

b) moving the amorphous ferromagnetic strip through a heating environment while subjecting the amorphous ferromagnetic strip to a magnetic field transversely with respect to the strip direction, and selecting a speed of movement of the amorphous ferromagnetic strip through said heat environment so that the amorphous ferromagnetic strip is heated to a temperature of $250° \leqq T \leqq 450°$ C. for a heat treatment time of $0.5\ s \leqq t \leqq 60\ s$; and c) cutting a plurality of core strips to length from the heat-treated, amorphous ferromagnetic strip and winding each of said core strips to form a strip-wound core.

2. The production method as claimed in claim 1, wherein step b) is further defined by selecting the speed of movement so that the amorphous ferromagnetic strip is heated to a temperature of $300° \leqq T \leqq 400°$ C. for a heat-treatment time of $t \leqq 30$ s.

3. The production method as claimed in claim 1, wherein step a) is further defined by selecting the proportion of iron and/or manganese in the alloy so that the amorphous ferromagnetic strip has a saturation magnetostriction of $|\lambda_s| \leqq 0.1$ ppm after step b).

4. The production method as claimed in claim 1, wherein step a) is further defined by selecting the proportion of iron and/or manganese in the allow so that the amorphous ferromagnetic strip has a saturation magnetostriction of $|\lambda_s| \leqq 0.05$ ppm after step b).

5. A method as claimed in claim 1 wherein step c) comprises winding each of said core strips to form a strip-wound core having an average diameter of less than or equal to 50 mm.

6. A method as claimed in claim 1 wherein step c) comprises winding each of said core strips to form a strip-wound core having an average diameter of less than or equal to 10 mm.

7. A method as claims in claim 1 wherein step c) comprises winding each of said core strips to form a toroidal strip-wound core.

* * * * *